US006101261A

United States Patent [19]

Brown, Sr. et al.

[11] Patent Number: 6,101,261

[45] Date of Patent: Aug. 8, 2000

[54] VARIABLE TILT LOUD SPEAKER ENCLOSURE

[75] Inventors: James W. Brown, Sr.; Samuel Steven Everett, both of Meridian, Miss.

[73] Assignee: Peavey Electronics Corporation, Meridian, Miss.

[21] Appl. No.: 09/098,438

[22] Filed: Jun. 17, 1998

[51] Int. Cl.[7] ..... H04R 25/00

[52] U.S. Cl. ..... 381/386; 381/387; 381/86; 181/199

[58] Field of Search ..... 381/86, 87, 386, 381/387, 390, FOR 165; 181/199

[56] References Cited

U.S. PATENT DOCUMENTS

| | | | |
|---|---|---|---|
| 1,585,397 | 5/1926 | Loycano | 248/455 |
| 2,388,567 | 11/1945 | Patterson, Jr. | 455/351 |
| 3,147,948 | 9/1964 | Evanoff | 248/455 |
| 3,448,950 | 6/1969 | Kluge | 248/649 |
| 4,753,408 | 6/1988 | Wailes | 248/371 |
| 5,024,407 | 6/1991 | Bartley | 248/164 |
| 5,161,771 | 11/1992 | Domeier | 248/676 |
| 5,190,254 | 3/1993 | Maguire | 248/164 |
| 5,190,258 | 3/1993 | Yu | 248/286 |
| 5,577,704 | 11/1996 | Pierce et al. | 248/688 |
| 5,872,340 | 2/1999 | Anagnos | 181/199 |

FOREIGN PATENT DOCUMENTS

| | | | |
|---|---|---|---|
| 291569 | 6/1928 | United Kingdom | 381/165 |

OTHER PUBLICATIONS

Photocopies of photographs of Fender Tilt Back Amplifier/ Speciman.

*Primary Examiner*—Curtis A. Kuntz
*Assistant Examiner*—Phylesha Dabney
*Attorney, Agent, or Firm*—Dykema Gossett PLLC

[57] ABSTRACT

An enclosure has one or more loud speakers therein adjacent the front of the enclosure; and the back of the enclosure defines an opening. A pair of tilt members are mounted on inner surfaces of the enclosure at opposite sides thereof for sliding and rotating movement with respect to the enclosure. The tilt members each include an elongated straight portion and an offset portion at one end of the straight portion. The tilt members are stored completely within the enclosure and may be adjusted to extend through and rearwardly of the opening at the rear of the enclosure to engage a support surface. A locking member locks each tilt member in adjusted position. Electronic means for operating the loud speakers may be disposed within the enclosure at the top thereof.

15 Claims, 2 Drawing Sheets

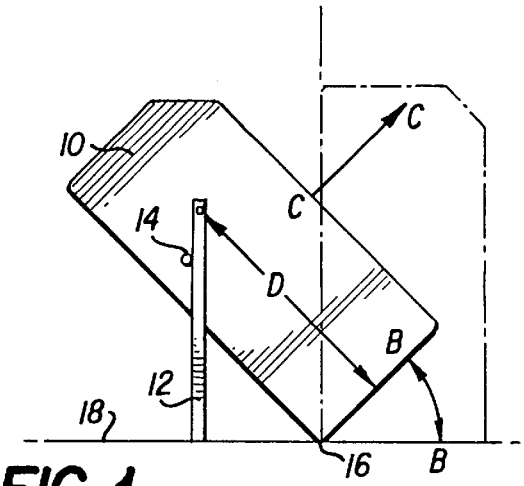
FIG. 1 (PRIOR ART)
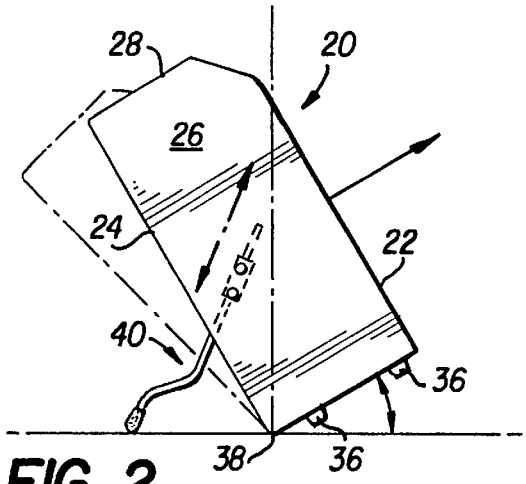
FIG. 2
FIG. 5
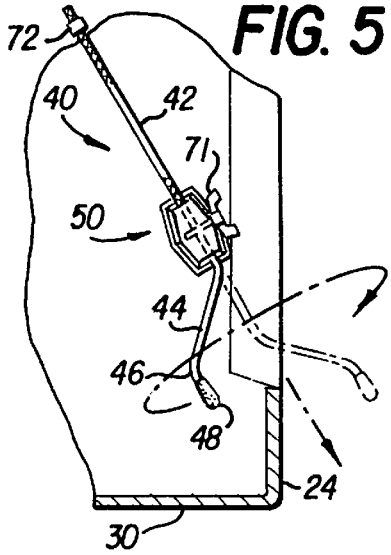
FIG. 8
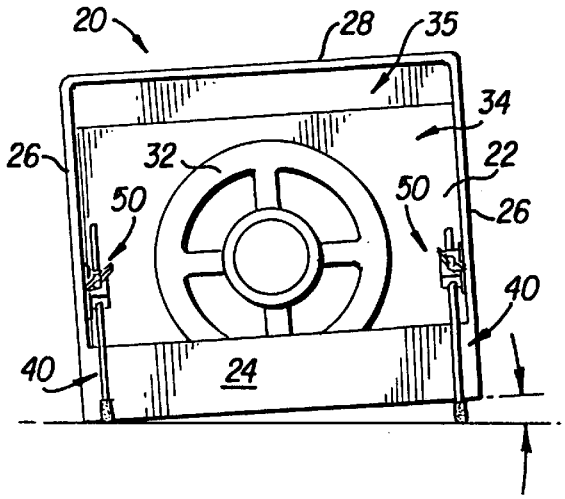
FIG. 6
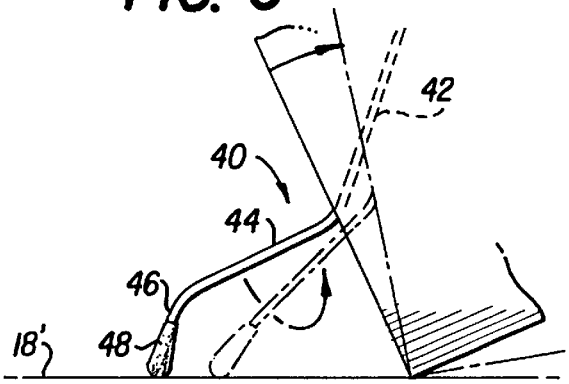
FIG. 7
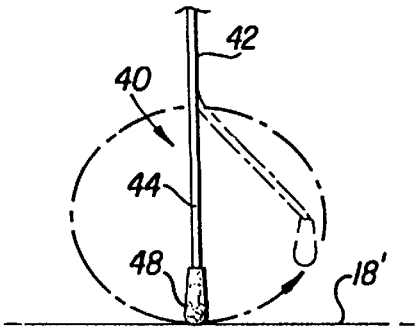

VARIABLE TILT LOUD SPEAKER ENCLOSURE

BACKGROUND OF THE INVENTION

The present invention relates to a variable tilt loud speaker enclosure, and more particularly to a guitar amplifier wherein electronic means for operating the loud speaker is also disposed within the enclosure.

While the invention may be utilized with any type of loud speaker enclosure wherein no electronic means is disposed within the enclosure, it is especially adapted to be utilized as a guitar amplifier. It may be desirable to tilt a loud speaker enclosure which is not a guitar amplifier in some instances, but it is particularly convenient that the enclosures of guitar amplifiers be provided with some means for tilting the enclosure relative to a support surface.

The enclosures of most guitar amplifiers are essentially rectangular boxes with electronic components located in the top part of the enclosure with a loud speaker baffle board disposed immediately under the electronic components. The baffle board is disposed at the front part of the enclosures, and a plurality of loud speakers are attached thereto. Since most guitar amplifiers are less than 24 inches in height, the enclosure of the amplifier usually sits on a support surface such as the floor with the loud speakers facing forward and directed essentially parallel to the floor.

Guitar players traditionally perform standing up with their amplifiers on the floor or often on a chair or in some kind of a stand to facilitate raising the amplifier closer to the player's ear level. Tilt-back stands used to support the amplifier are designed to aim the amplifier upward at some desired angle, thus allowing the player to hear himself play as opposed to the sound basically beaming out of the speakers at knee-level.

Guitar amplifiers have been provided in the prior art with means for supporting the amplifiers in a tilted angle. Such prior art means is in the form of two legs which are pivotally supported on the outside of opposite sides of the enclosure. Since the legs are mounted externally of the enclosure, the legs have to be short enough so that they do not extend below the enclosure when it is in vertical position. When the enclosure is tilted backwards, the legs swing about their pivot supports until they engage stop members extending outwardly from the sides of the enclosure.

This prior art arrangement allows the enclosure to be tilted at approximately a 45 degree angle to a support surface because of the location of the center of gravity of the amplifier plus the limited length of the legs. The 45 degree angle is far too great for most applications. Bands usually play on risers above a supporting surface, and are therefore located at a higher level than the audience. The 45 degree angle therefore directs the sound over the heads of the audience which is obviously undesirable.

Furthermore, this prior art enable only two modes of operation. The amplifier can be used either in its normal vertical orientation or it can be tilted back 45 degrees. There is no other possible angle which can be obtained between a 45 degree and 90 degree relationship to a supporting surface. It is therefore desirable to provide a construction wherein the enclosure can be tilted to an infinite number of different positions between opposite limits.

A further disadvantage of the prior art as discussed above is that the legs are disposed externally of the cabinet and are subject to damage when the legs are not in use such as when the cabinet is transported from one location to another.

SUMMARY OF THE INVENTION

In the present invention, loud speaker means is supported in the usual location adjacent the front of the enclosure. The adjustable tilt means comprises a pair of tilt members which are stored entirely within the enclosure adjacent the opposite sides thereof. This eliminates the possibility of damage to the tilt members, especially when the enclosure is moved from one place to another, and further prevents the tilt members from damaging anything outside of the enclosure when the tilt members are in stored position.

When it is desired to tilt the enclosure to a desired angle with respect to a support surface, the tilt members may be extended through an opening at the back of the enclosure so as to engage a support surface. Manually operable locking means is provided for quickly and easily locking the tilt members in adjusted position or releasing them from a particular adjusted position when desired.

The tilt members include an elongated straight portion and an offset portion at one end of the straight portion. The tilt members are supported on support means for both sliding and rotating movement relative to the support means. This dual movement enables the tilt members to assume an infinite number of positions relative to the enclosure within opposite limits such that the enclosure may be selectively supported in a tilted position throughout a wide range of angles relative to a support surface. This represents a major advantage over the prior art discussed above.

The improvements of the present invention may be utilized with any loud speaker enclosure not having any electronic means within the enclosure or with an enclosure having electronic means therein for operating the loud speaker means as is the case in a guitar amplifier.

BRIEF DESCRIPTION OF THE DRAWINGS

FIG. 1 is an elevation of a prior art construction showing an enclosure in a tilted position;

FIG. 2 is a view similar to FIG. 1 illustrating the invention;

FIG. 5 is view of a tilt member and associated support means mounted on an inner surface of the enclosure;

FIG. 6 is a side view illustrating how a tilt member may be adjusted into an infinite number of adjusted positions between opposite limits;

FIG. 7 is an end view of the tilt member shown in FIG. 7; and

FIG. 8 is a back view of the enclosure shown the manner in which it can be adjusted in a side to side direction.

DESCRIPTION OF THE PREFERRED EMBODIMENT

Figure 3:
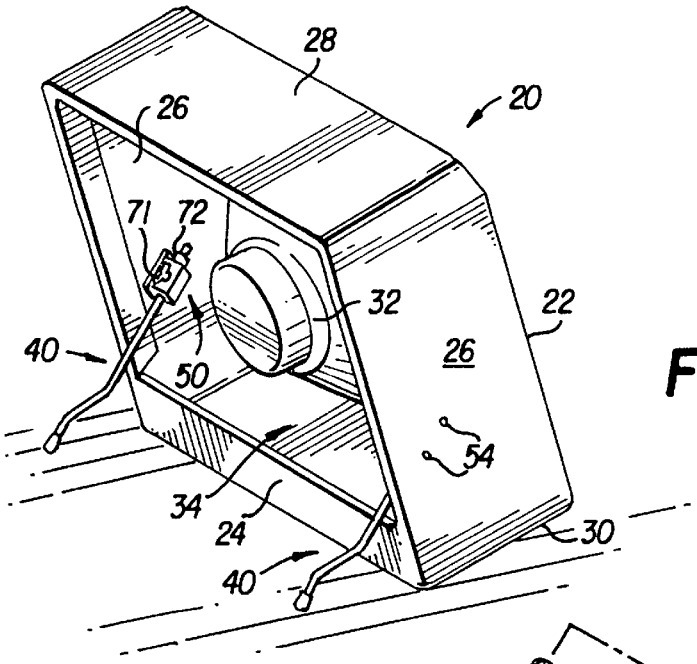
FIG. 3 is a top perspective view of the back of the enclosure.

Referring now to the drawings wherein like reference characters designate corresponding parts throughout the several views, a prior art guitar amplifier is shown in FIG. 1. The enclosure 10 of the amplifier has a pair of similar legs 12 one of which is seen in FIG. 1 which are pivotally supported for pivotal movement about axes A on opposite sides of the enclosure. The broken line position shown in FIG. 1 shows the enclosure when in vertical position with the bottom of the enclosure resting on a support surface.

The solid line position shows the enclosure when it is moved into its one and only tilted position, wherein leg 12 engages a stop pin 14 extending outwardly from the side of the enclosure. In this position, the rear edge 16 of the enclosure rests on a support surface 18, and the bottom of leg 12 also rests on surface 18. The enclosure is supported at a 45 degree angle with respect to surface 18 as indicated by arrow B—B. When the enclosure is pushed in the direction of arrow C—C, it will pivot about its rear edge of the enclosure back into the broken line position, whereupon arms 12 will also assume a vertical orientation. The length of arms 12 must be less than the distance D so that they do not engage the surface 18 when the enclosure is upright.

Referring to FIGS. 2, 3 and 8, enclosure 20 of the invention includes a front portion 22, a back portion 24, opposite side portions 26, a top portion 28 and a bottom portion 30. Loud speaker means 32 is supported in a conventional manner adjacent front portion 22. While a single loud speaker is illustrated, it is apparent that the loud speaker means may comprise a plurality of speakers such as in a guitar amplifier. Normally, back portion defines an opening 34 of such a dimension that part of the back portion of the enclosure is open. As seen in FIG. 8, in the case of a guitar amplifier, a compartment 35 is provided within the enclosure adjacent the top portion 28 thereof. The conventional electronic components for operating the loud speaker means are mounted within compartment 35.

Four conventional feet 36, two of which are visible in FIG. 2, are disposed adjacent the four corners of the bottom portion of the enclosure in the usual manner. The two feet adjacent the rear edge 38 of the bottom portion of the enclosure have been moved slightly forward toward the front portion of the enclosure to enable the enclosure to be tilted to smaller angles relative to support surface 18'. It is noted that the angle defined by arrow E—E is significantly less than 45 degrees, the position of the enclosure being shown in broken lines when supported at an angle of 45 degrees.

If it is desired to tilt the enclosure to an angle lass than that shown in FIG. 2, the enclosure may be tilted so that the enclosure is supported on the two feet adjacent edge 38 while the edge is spaced from surface 18'. By moving these two feet slightly forward, it enables the center of gravity of the enclosure to be positioned to the left of a vertical line extending through these feet so that the enclosure will remain in the tilted position when set for small degrees of tilt.

Figure 4:
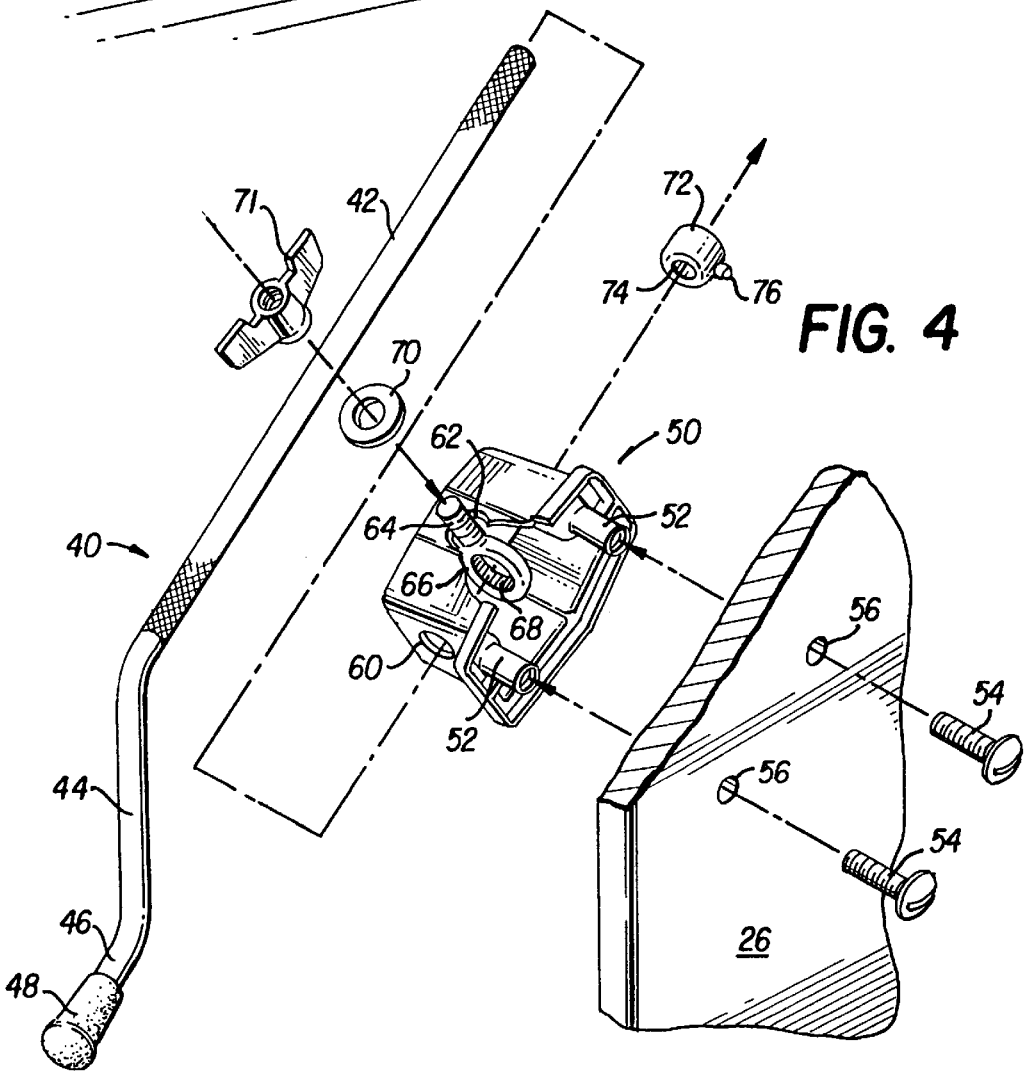
FIG. 4 is an exploded view showing the details of construction tilt member and the support means therefor.

Referring non to FIG. 4, a tilt member 40 formed of metal includes an elongated portion 42 which joins with an angled portion 44 which in turn joins with an offset end portion 46 having a cap 48 disposed over the terminal end thereof. The cap is formed of a suitable material such as rubber which is adapted to engage a support surface and prevent slippage relative to such surface. The outer surface of elongated portion 42 is knurled to provide a rough surface.

A support means 50 comprises a one-piece metallic bracket having a pair of tubular portions 52 having threaded openings opening at the outer ends thereof. These threaded openings are adapted to receive screws 54 which are adapted to pass through openings 55 formed through side portion 26 of the enclosure. A pair of aligned openings 60, one of which is visible in FIG. 4 are formed through the walls of the bracket far receiving portion 42 of tilt member 40.

A further opening 62 is formed through a wall of the bracket and receives the threaded end 64 of an eye-bolt 66 forming an annular ring defining a hole formed therethrough for receiving portion 42 of tilt member 40. A plurality of serrations 68 are formed around the inner periphery of the hole formed in the eye-belt for engaging the knurled outer surface of portion 42 of tilt member 40. A washer 70 surrounds end 64 of the eye-bolt, and a wing nut 71 is threaded onto end 64 of the eye-bolt.

When portion 42 of tilt member 40 is passed through openings 60 in the support bracket as well as the hole formed through eye-bolt 66, rotation of the wing nut to draw the eye-bolt upwardly as seen in FIG. 4 will cause portion 42 of the tilt member to be securely locked to the support bracket 50.

A collar 72 has a bore 74 formed therethrough for receiving portion 42 of tilt member 40. A set screw 76 is threaded into a radial bore which is formed in the collar and intersects bore 74. The collar is placed ever the upper end of portion 42 as shown in FIG. 4 and moved downwardly to a desired position whereupon the collar may be locked in place on the tilt member by means of the set screw. The collar limits outward movement of the associated tilt member when it comes into engagement with bracket 50.

The collar 72 serves as an adjustable device which pre-sets the amount of outward sliding movement of the associated tilt member each time the tilt member is moved outwardly from stored position to a position for supporting the enclosure at a desired tilt angle on a supporting surface. Therefore, a user only needs to loosen the wing nut, extend the tilt member as far as it will go and then re-tighten the wing nut, whereupon the enclosure can be tilted into the desired position. The enclosure will then remain in tilted position until it is desired to return it to its vertical position. The wing nut can then be loosened and the tilt member pushed back into its stored position within the enclosure. The wing nut can then again be tightened to retain the tilt member in stored position so that the enclosure may be conveniently transported.

The tilt members and support brackets 50 are mounted on inner surfaces formed at opposite side portions of the enclosure. The pairs of tilt members and support brackets are identical to one another in construction. A tilt member is shown in FIG. 5 in solid lines in its stored position completely within the enclosure. The wing nut can be backed off of the threaded and of the eye-bolt to allow portion 42 of the tilt member to slide and be rotated relative to bracket 50 into the broken line position. The tilt member may then be locked in the position shown in broken lines by tightening the wing nut, or the tilt member can also slide lengthwise of the fitting to extend the tilt member outwardly further through the opening in the back portion of the enclosure. Such sliding movement of the tilt member can vary the tilt angle of the enclosure when tilted back to rest on said tilt member.

As seen in FIGS. 6 and 7, rotation of the tilt member 40 about the axis of portion 42 is further adapted to place the offset end of the tilt member into an infinite number of different positions within certain limits. The tilt angle of the enclosure can be varied as desired by sliding and rotating the tilt member relative to the associated support bracket. The desired tilted position is retained by tightening the associated wing nut.

As seen in solid lines in these two figures, the enclosure is supported in a first tilted position. If it is desired to support the enclosure at a greater angle with respect to the support surface, tilt member 40 may be rotated into the broken line position whereby when cap 48 engages support surface 18' the enclosure will be disposed in the broken line position.

As seen in FIG. 8, the tilt members at opposite sides of the enclosure can be adjusted to different degrees such that the tilt member 40 on the right side of this figure is extended more than the tilt member 40 on the left side of the figure. This is possible since the tilt members at opposite sides of the enclosure can be independently adjusted to properly support the enclosure on a sloping support surface. The enclosure can therefore be supported at an angle F with respect to the support surface 18'. This technique is useful for attaining stability on uneven surfaces.

It is noted that the tilt member 40 is a conventional leg for supporting a tom tom drum, except that the knurled outer surface of elongated portion 42 has been extended from the free end thereof almost to angled portion 44. Bracket 50 and the locking means are a conventional bracket used with a conventional leg for supporting a tom tom drum. When used to support a tom tom drum, the elongated portions 42 are disposed vertically and the brackets are secured to the drum so that the vertical height of the drum can be adjusted. Three or more brackets are secured at equally spaced points around the periphery of the tom tom drum. There is no component corresponding to collar 72 of the invention. It is noted that the tilt member may have many different configurations, and for example, it may have a continuously curved configuration.

While conventional tom tom drum legs and brackets are employed in the invention because they are readily available on the open market, these components provide a new combination with a loud speaker enclosure and operate in an entirely different manner than in the prior art to provide a unique result.

The invention has been described with reference to a preferred embodiment. Obviously, various modifications, alterations and other embodiments will occur to others upon reading and understanding this specification. It is our intention to include all such modifications, alterations and alternate embodiments insofar as they come within the scope of the appended claims or the equivalent thereof.

What is claimed is:

1. A variable tilt loud speaker enclosure comprising, an enclosure having a front portion, a back portion, side portions, a top portion and a bottom portion, loud speaker means supported by said enclosure adjacent said front portion, said back portion defining an opening, adjustable tilt means supported by said enclosure for storage completely within said enclosure, said tilt means being adjustable relative to said enclosure for extension outwardly through said opening to engage a support surface, and means for locking said tilt means in extended position to hold said enclosure in tilted relationship to the support surface.

2. An enclosure as defined in claim 1 wherein said tilt means comprises a pair of tilt members spaced a substantial distance from one another.

3. An enclosure as defined in claim 2 wherein said tilt members are independently adjustable relative to said enclosure.

4. An enclosure as defined in claim 2 wherein each of said tilt members is mounted for both sliding and rotating movement relative to said enclosure.

5. An enclosure as defined in claim 2 wherein each of said tilt members comprises an elongated portion having an offset end portion.

6. An enclosure as defined in claim 5 including a stop collar adjustably mounted on said elongated portion of each of said tilt members.

7. An enclosure as defined in claim 1 including electronic means for operating said loud speaker means, said electronic means being disposed within said enclosure adjacent said top portion.

8. A variable tilt loud speaker enclosure comprising, an enclosure having a front, a back, a pair of opposite sides, a top and a bottom, loud speaker means supported within said enclosure adjacent said front of the enclosure, said back of the enclosure being open, a pair of adjustable tilt members, a pair of support means for supporting said tilt members adjacent said opposite sides of the enclosure so that the tilt members can be stored entirely within said enclosure, said tilt members being supported for movement relative to said support means for adjusting the tilt members to extend outwardly through and rearwardly of the open back of the enclosure to engage a support surface, and locking means for locking said tilt members in fixed position relative to the associated support means.

9. An enclosure as defined in claim 8 wherein said enclosure includes inner surfaces at each of said opposite sides, each of said support means being fixedly mounted on one of said inner surfaces.

10. An enclosure as defined in claim 8 wherein said tilt members may be independently adjusted with respect to the associated support means.

11. An enclosure as defined in claim 8 wherein each of said support means includes a manually operable locking member for locking the associated tilt member in adjusted position.

12. An enclosure as defined in claim 8 wherein each of said tilt members includes an elongated straight portion and an offset end portion at one end of the straight portion.

13. An enclosure as defined in claim 12 including a stop collar adjustably mounted on said elongated straight portion of each of said tilt members.

14. An enclosure as defined in claim 12 wherein said straight portion of each tilt member is slidable and rotatable with respect to the associated support means.

15. An enclosure as defined in claim 8 including electronic means for operating said loud speaker means, said electronic means being disposed within said enclosure adjacent the top thereof.

* * * * *